US010043616B2

(12) United States Patent
Asento et al.

(10) Patent No.: US 10,043,616 B2
(45) Date of Patent: Aug. 7, 2018

(54) HAND HELD CONTROL SWITCH

(71) Applicant: Carestream Health, Inc., Rochester, NY (US)

(72) Inventors: Robert J. Asento, Rochester, NY (US); William F. Dassero, Rochester, NY (US)

( * ) Notice: Subject to any disclaimer, the term of this patent is extended or adjusted under 35 U.S.C. 154(b) by 6 days.

(21) Appl. No.: 15/372,722

(22) Filed: Dec. 8, 2016

(65) Prior Publication Data

US 2018/0019075 A1 Jan. 18, 2018

Related U.S. Application Data

(60) Provisional application No. 62/363,387, filed on Jul. 18, 2016.

(51) Int. Cl.

| | |
|---|---|
| ***H01H 9/26*** | (2006.01) |
| ***H01H 13/72*** | (2006.01) |
| ***H01H 13/76*** | (2006.01) |
| ***H01H 9/02*** | (2006.01) |
| ***H01H 13/14*** | (2006.01) |
| ***H01H 13/81*** | (2006.01) |

(52) U.S. Cl.

CPC ..... *H01H 9/0235* (2013.01); *H01H 9/0271* (2013.01); *H01H 13/14* (2013.01); *H01H 13/81* (2013.01)

(58) Field of Classification Search

CPC .... H01H 9/0235; H01H 9/0271; H01H 13/14; H01H 13/81; H01H 3/00; H01H 3/02; H01H 3/04; H01H 3/12; H01H 3/161; H01H 21/00; H01H 21/04; H01H 21/36; H01H 21/54; H01H 23/14; H01H 23/141; H01H 2003/12; H01H 2003/16; H01H 2003/161; H01H 2009/066; H01H 2009/068; H01H 2221/00; H01H 2221/012; H01H 2221/016; H01H 2221/018; H01H 2231/032; H01H 13/18; H01H 13/50; H01H 13/52; H01H 1/00; H01H 1/22; H01H 1/225

USPC ..... 200/5 D, 5 A, 6 BA, 302.3, 318, 322, 200/332, 335, 337, 339, 343, 345

See application file for complete search history.

(56) References Cited

U.S. PATENT DOCUMENTS 6,737,592 B1 * 5/2004 Hoang ..... H01H 23/003 200/1 B

* cited by examiner

*Primary Examiner* — Anthony R. Jimenez

(57) ABSTRACT

A hand held switch having a depressible button linked to an electromechanical two-stage switch transmits first and second type electric signals in response to a depth of the button press. A pivoting lever links the button to the switch and is designed to move the switch in response to a button press for improved tactile control.

20 Claims, 3 Drawing Sheets

HAND HELD CONTROL SWITCH

CROSS REFERENCE TO RELATED APPLICATIONS

This application claims priority to U.S. Patent Application Ser. No. 62/363,387, filed Jul. 18, 2016, in the name of Asento et al., and entitled CONTROL SWITCH.

BACKGROUND OF THE INVENTION

The subject matter disclosed herein relates to a dual-stage hand held switch. In particular, to a switch that may be used for activating radiographic imaging equipment having an x-ray tube to obtain an x-ray exposure.

Current x-ray equipment often uses a wired switch to control the x-ray exposures. In one prior art design, a hand held device includes a two position switch where, in one position, it initiates a preparation of the equipment and, in the second position, it initiates the exposure.

The discussion above is merely provided for general background information and is not intended to be used as an aid in determining the scope of the claimed subject matter.

BRIEF DESCRIPTION OF THE INVENTION

A hand held switch having a depressible button that is linked to an electromechanical two-stage switch transmits first and second type electric signals in response to a depth of the button press. A pivoting lever links the button to the switch and is designed move the switch about the same distance, half the distance, or less, as a depth of the button press. An advantage that may be realized in the practice of some disclosed embodiments of the control switch is improved tactile feel, stability and control.

In one embodiment, a hand held switch assembly may include a rigid manually movable element and a depressible electromechanical two-stage switch which transmits a first type electric signal in response to being depressed to a first depth and a second type electric signal in response to being depressed to a second depth. A rigid pivoting lever mechanically couples the manually movable element to the two-stage switch and depresses the two-stage switch in response to a manual movement of the element. The rigid pivoting lever depresses the two-stage switch to the first depth when the manually movable element is moved about 1×, 2×, or more, of the distance of the first depth.

In another embodiment, a hand held switch may include a button movable to a first button depth and to a second button depth. An electromechanical switch is mechanically coupled to the button and transmits a first type electric signal in response to the button being pressed to the first button depth. The switch transmits a second type electric signal in response to the button being pressed to the second button depth. A pivoting lever links the button to the switch and is designed move the switch about half the distance as a depth of the button movement.

In another embodiment, a hand held switch assembly includes a rigid manually depressible button and a movable switch element configured to transmit a first electric signal in response to being moved to a first depth and to transmit a second electric signal in response to being moved to a second depth. A rigid pivoting lever is mechanically coupled to both the button and to the switch element, and is configured to move the switch element in response to a manual depression of the button. The pivoting lever is configured to move the switch element to the first depth when the button is depressed for a distance of about 1×, 2×, or more, of a distance of the first depth and to a second depth when the button is depressed for a distance of about 1×, 2×, or more, of a distance of the second depth.

In another embodiment, a hand held switch assembly includes a button configured to move to a first position and a second position when pressed. An electromechanical switch is coupled to the button and is configured to transmit a first electric signal in response to the button being pressed to the first position and to transmit a second electric signal in response to the button being pressed to the second position. A pivoting lever provides mechanical coupling between the button and the switch. The pivoting lever is configured to move a piston in the switch to a first switch depth corresponding to the first button depth and to a second switch depth corresponding to the second button depth.

This brief description of the invention is intended only to provide a brief overview of subject matter disclosed herein according to one or more illustrative embodiments, and does not serve as a guide to interpreting the claims or to define or limit the scope of the invention, which is defined only by the appended claims. This brief description is provided to introduce an illustrative selection of concepts in a simplified form that are further described below in the detailed description. This brief description is not intended to identify key features or essential features of the claimed subject matter, nor is it intended to be used as an aid in determining the scope of the claimed subject matter. The claimed subject matter is not limited to implementations that solve any or all disadvantages noted in the background.

BRIEF DESCRIPTION OF THE DRAWINGS

So that the manner in which the features of the invention can be understood, a detailed description of the invention may be had by reference to certain embodiments, some of which are illustrated in the accompanying drawings. It is to be noted, however, that the drawings illustrate only certain embodiments of this invention and are therefore not to be considered limiting of its scope, for the scope of the invention encompasses other equally effective embodiments. The drawings are not necessarily to scale, emphasis generally being placed upon illustrating the features of certain embodiments of the invention. In the drawings, like numerals are used to indicate like parts throughout the various views. Thus, for further understanding of the invention, reference can be made to the following detailed description, read in connection with the drawings in which.

DETAILED DESCRIPTION OF THE INVENTION

Figure 1:
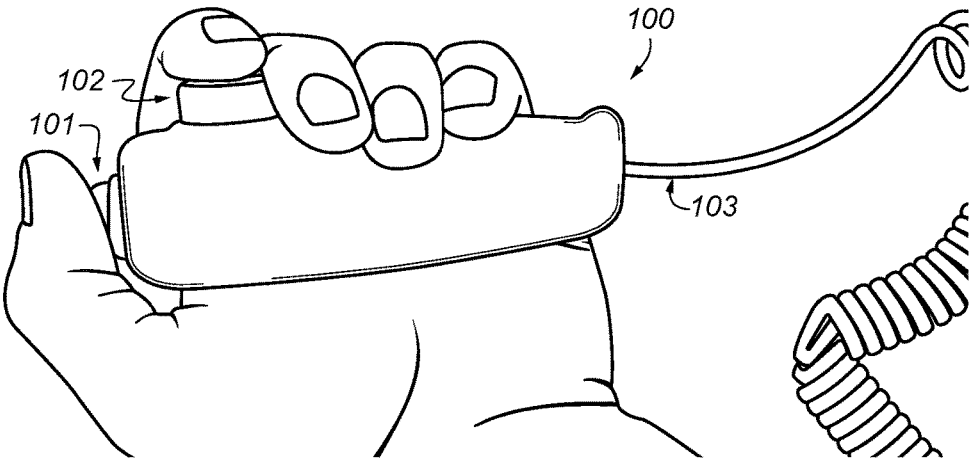
FIG. 1 is an image of an exterior of a generic prior art hand held switch.

FIG. 1 shows a prior art hand held electrical switch 100 that includes two buttons 101, 102 that may be separately manually depressed by an operator to initiate transmission of electrical signals through a conductive cable 103. The signals are received at an opposite end of the cable 103 at an electrical or electromechanical device that may respond to the signals by activating (starting) or deactivating (stopping) an electrical or electromechanical function performed by the connected electrical or electromechanical device. In one embodiment, the transmitted electrical signals may be used to initiate a preparation stage of an x-ray tube such as by activating rotation of a rotating anode therein. The transmitted electrical signals may further include an activation signal used to activate a single firing or a firing sequence of the x-ray tube which emits radiographic energy (x-rays) in response thereto.

Figure 2:
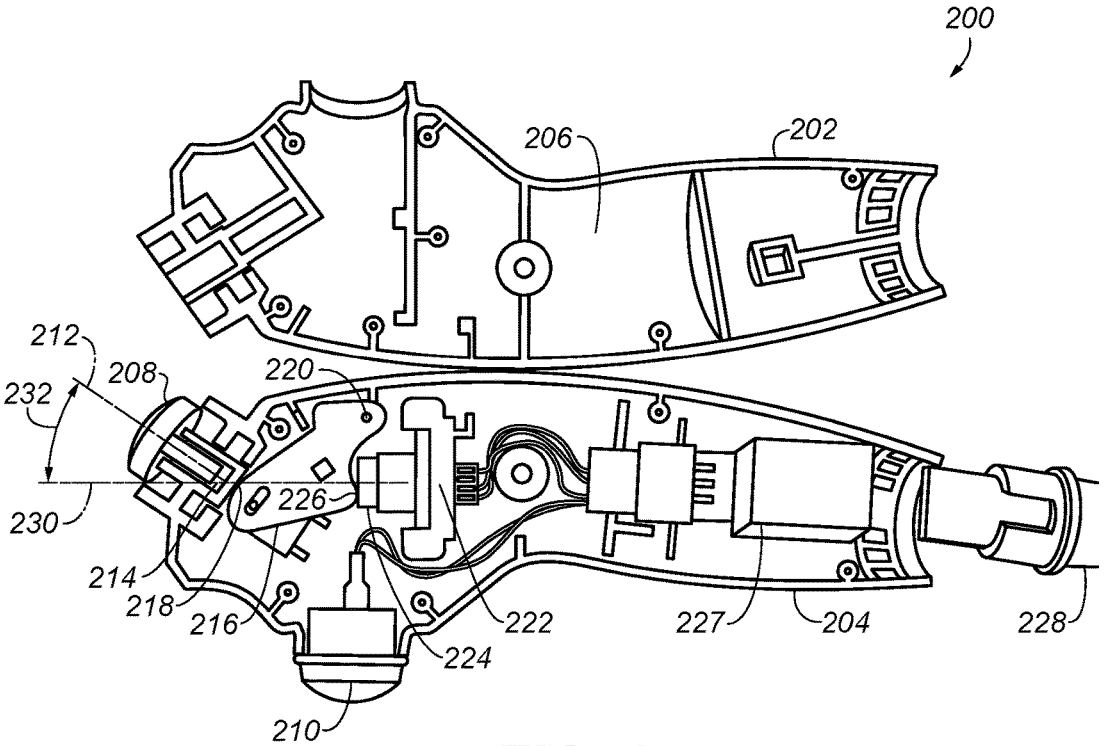
FIG. 2 is an image showing an interior of one exemplary embodiment of a hand held switch of the present invention.
Figure 3:
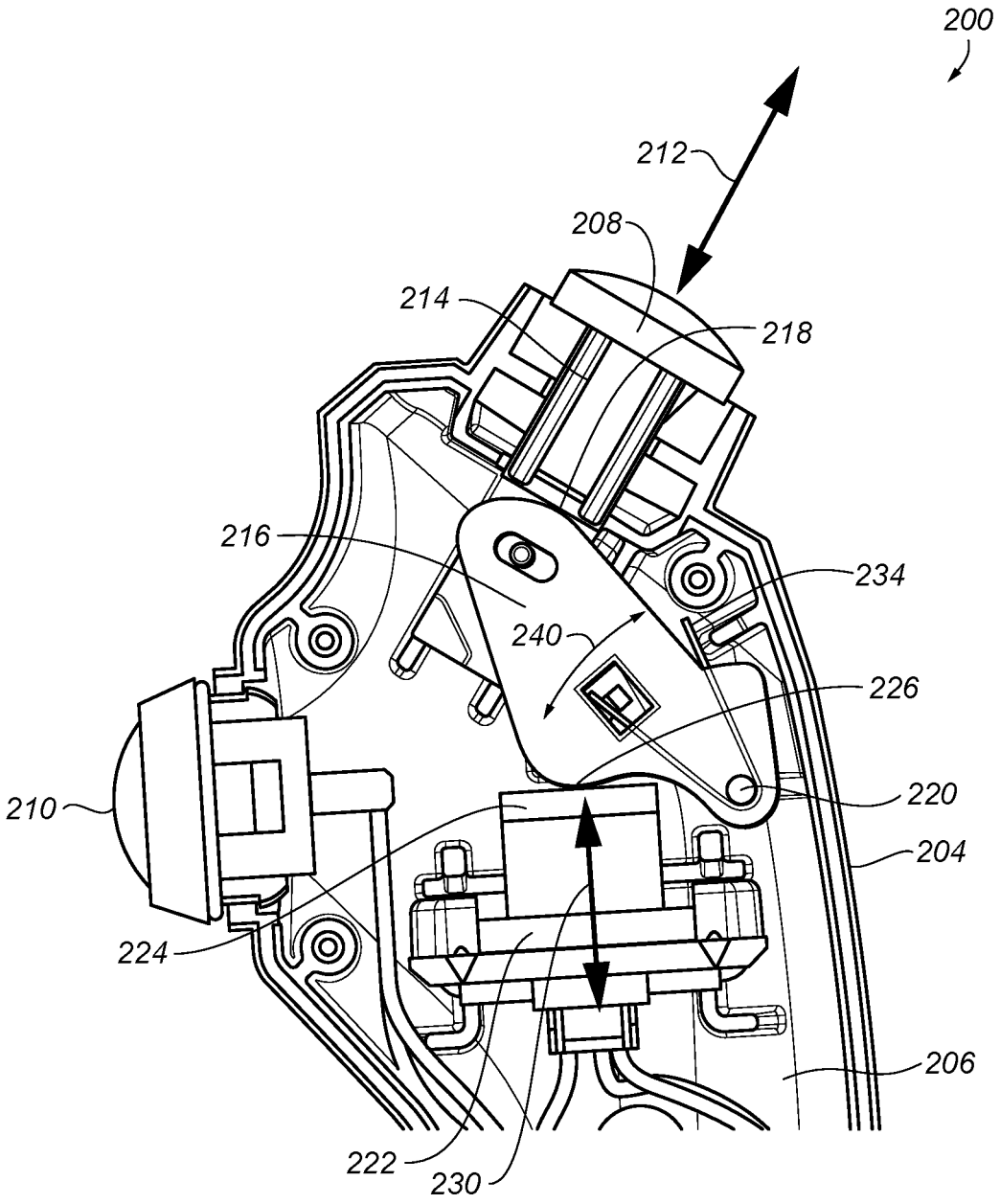
FIG. 3 is a cross section close-up view of a portion of an exemplary embodiment of a hand held switch of the present invention.
Figure 4:
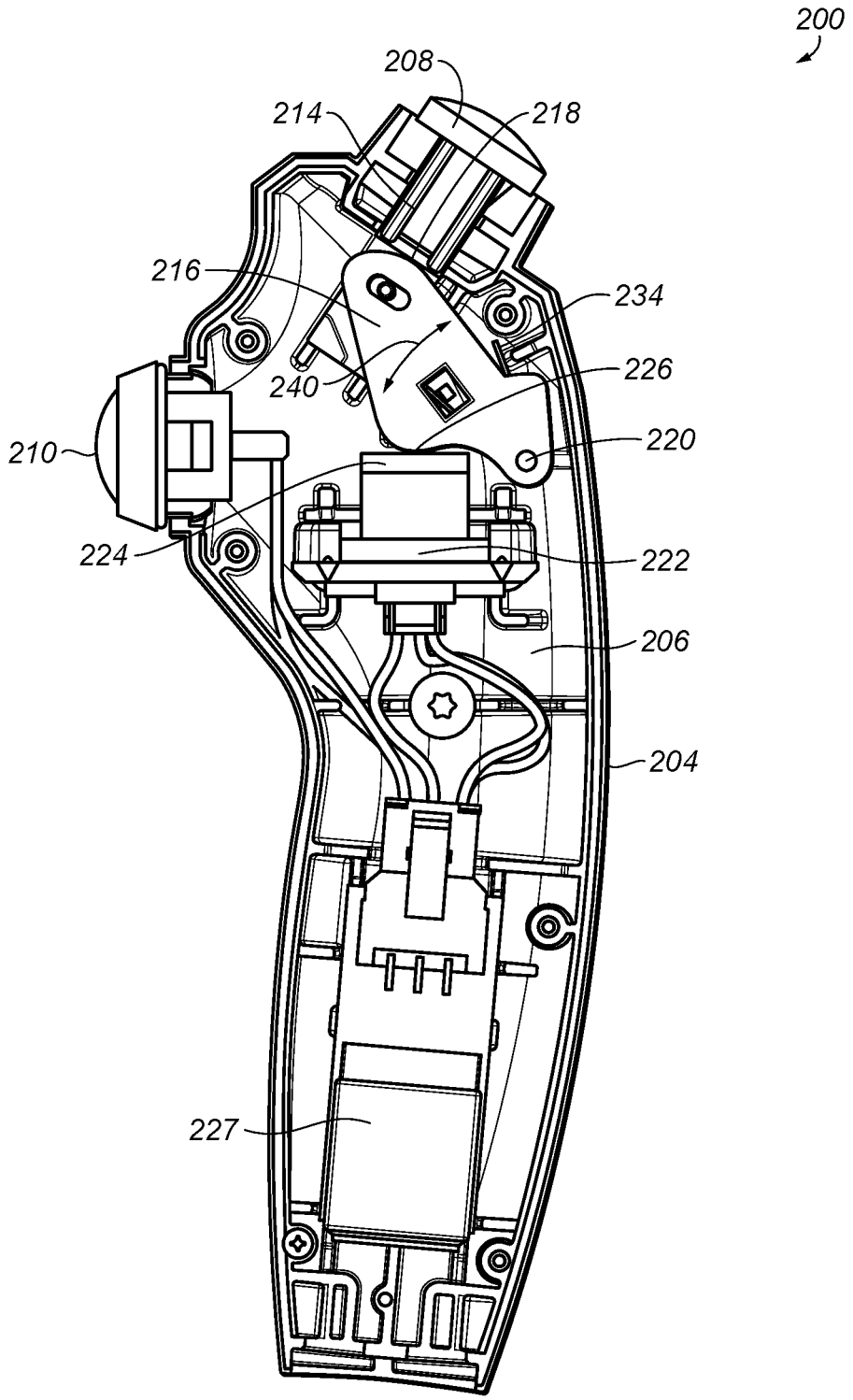
FIG. 4 is a line drawing cross-section view of one exemplary embodiment of a hand held switch of the present invention.

The following description of embodiments of the present invention is directed to FIGS. 2-4, whereby FIG. 2 shows an image of the inventive hand held control switch; FIG. 3 shows a close-up view of a portion of the inventive hand held control switch; and FIG. 4 shows a line drawing of the inventive hand held control switch. An embodiment of a hand held electrical switch assembly 200 that may include a housing body having at least two portions, or halves, 202, 204, which, when fully assembled, may be positioned to abut each other and be fixed together to define and enclose an interior space 206 within the housing. The electrical switch assembly 200 includes two buttons 208, 210, at least one of which may be a rigid, manually depressible button 208. The manually depressible button 208 may include a narrower portion such as an integrally formed shaft that is configured to travel back-and-forth parallel to (along) a linear axis, or button line, 212 within a channel 214 in the housing. The channel 214 may have a cross-section whose shape matches a shape of the cross-section of the shaft but slightly larger to allow slidable movement of the shaft therethrough. One end of the button 208 may be selectively depressed by an operator such that the button 208 (shaft) slides to one or more selectable depths (distances) into the channel 214. One wider end of the button 208 is configured to be manually contacted and depressed by an operator, and the other end of the button (narrower shaft) is configured to engage, contact, and move, in an angular rotation direction 240, a pivoting lever 216 as the button 208 is depressed. The narrower shaft end of the button 208 engages a slidable contact area 218 of the pivoting lever 216 as the pivoting lever 216 pivots. As the depressed button engages the pivoting lever 216 at the contact area 218, it causes the pivoting lever 216 to pivot, or rotate, about a fixed pivot axis 220 in one of the directions 240 toward a two-stage switch 222, for an angular distance corresponding to a depth (distance) that the button 208 (shaft) is selectively depressed. The two-stage switch 222 is a known, commercially available switch, whose operation is described herein as it pertains to the present hand held switch, and is not described in further detail. The fixed pivot axis 220 may be formed by a pin that is attached to, or is integrally formed as part of, the housing portion 204 and that extends through an opening in the pivoting lever 216, which combination of pin and opening provides a rotatable sliding contact therebetween.

As the button 208 is manually depressed, one end of the button 208 contacts the pivoting lever 216 at the contact area 218 which causes the pivoting lever 216 to simultaneously pivot about the axis 220. The pivoting lever 216 includes another sliding contact area 226 that contacts, engages, and moves a switch element 224 toward the right, as shown in FIG. 2, as the pivoting lever 216 pivots about the axis 220. The switch element 224 may be formed in the shape of a movable cylinder and may be referred to herein as a piston 224. The switch element, or piston, 224 may be spring biased to in an outward direction toward the pivoting lever 216. The pivoting lever 216 may include a generally planar shape, which plane is parallel to the page of FIG. 2, and may have a thickness that may be smaller, greater, or equal to a thickness, or diameter, of the proximate end of the shaft of the button 208. When the button 208 is released, it causes the pivoting lever 216 to pivot, or rotate, about a fixed pivot axis 220 in one of the directions 240 away from the two-stage switch 222, via the spring biased piston 224.

The hand held switch 200 includes a two-stage electrical switch 222 having the movable piston 224 that protrudes from a portion of the two-stage electrical switch 222 facing toward the pivoting lever 216. As the pivoting lever 216 pivots about the pivot axis 220, the second slidable contact area 226 of the pivoting lever 216 slidably engages the piston 224 and moves the piston 224 along a linear travel axis, or switch line, 230 into a body of the two-stage electrical switch 222. The depressible piston 224 is configured to electrically engage a first electrical contact within the body of two-stage electrical switch 222 as the piston 224 travels a first distance into the body of the two-stage electrical switch 222 under the force of the pivoting lever 216 corresponding to a first depth that the button 208 is depressed. As the button 208 is further depressed to a second button depth or position, the piston 224 is configured to travel a second distance into the body of the two-stage electrical switch 222 under the force of the pivoting lever 216 corresponding to the second depth that the button 208 is depressed. The piston 224 then electrically engages a second electrical contact within the body of two-stage electrical switch 222 at the second distance, which is greater than the first distance.

When the first contact within the two-stage electrical switch 222 is electrically engaged by the movable piston 224, the two-stage electrical switch 222 is configured to transmit a first type signal through a connected cable 228 (shown disconnected in FIG. 2) downstream to control a function performed by a connected electrical or electromechanical device. As the movable piston 224 is moved further into the two-stage electrical switch 222 the second contact within the two-stage electrical switch 222 is electrically engaged by the movable piston 224. In response, the two-stage electrical switch 222 is configured to transmit a second type signal through the connected cable 228. The separate signals may be distinguished physically by separate conductive wires in the connected cable 228, or the separate signals may be distinguished functionally by signal characteristics such as analog voltage level or another suitable characteristic, or by discrete digital characteristics such as by pulse code modulation or some other suitable digital intelligence. The signals may be received at another end, such as a terminal end, of the connected cable 228 directly by an electromechanical device to activate, deactivate, or change an operating mode of the device, or the signals may be received at a programmed processor that decodes digital type signals and may respond by activating or deactivating connected devices or functions according to variable program control. Such programmed processing may be included in a controller 227 within the housing of the hand held switch 200. The controller 227 may be fabricated to include a printed circuit board having digital circuitry electrically connected to the cable 228 and may be electrically connected indirectly or directly to the two-stage switch 222 to enable the generation of voltage signals or digitally encoded signals, corresponding to the electrical engagement of the first or second contacts therein, to be transmitted through the connected cable 228.

In one embodiment, the pivoting lever 216 pivoting axis 220 is disposed to one side (offset) of the linear travel axis, or switch line, 230 of the piston 224. The pivoting axis 220 may also be disposed to the same one side (offset) of the linear travel axis, or button line, 212 of the button 208. The button 208 linear travel axis 212 may be said to intersect the piston 224 linear travel axis 230 at an acute angle 232 of between about 10° and 80°, more preferably between about 20° and about 50°, and even more preferably between 25° and 40°. The configuration and shape of the pivoting lever 216 relative to the button 208 and the piston 224 provides a mechanical and tactile advantage in that the travel distance of the button 208 is about twice that of the piston 224 as the button 208 is depressed by an operator—a 2× mechanical and tactile advantage that allows an operator better control over selectively transmitting the first type and second type signals. Other configurations of the pivoting lever 216 may provide more or less than the 2:1 mechanical ratio described herein. Thus, the approximate 2:1 ratio described herein is but one embodiment of the disclosed invention. The provided mechanical advantage may be understood by noting that a distance from the pivot axis 220 to the contact area 218 of the pivoting lever 216, which contact area 218 engages the button 208, is about twice greater than a distance from the pivot axis 220 to the contact area 226 of the pivoting lever 216, which contact area 226 engages the piston 224. Therefore, in another embodiment, a dimension of the pivoting lever 216 may be extended or shortened such that the relative distances between the pivot axis 220 to the contact area 218 and the pivot axis 220 to the contact area 226 may be varied to provide different mechanical ratios that may be greater or less than the 2:1 ratio described herein.

A spring bias member 234 (FIGS. 3, 4) may be used to bias the pivoting lever 216 against the piston 224, which bias pressure is insufficient to move the piston 224. In one embodiment, the spring bias member 234 may include a V-shaped spring having one end that abuts a fixed interior feature of the housing 204 and a second end abutting a feature on the pivoting lever 216 to bias the pivoting lever 216 against the piston 224 and thereby preload the pivoting lever 216 against the piston to avoid rattle and ensure tactile response during use of the button 208. The piston 224 may be spring biased to return itself as well as the pivoting lever 216, in a clockwise direction in the views of FIGS. 3-4, and the button 208 to starting positions after a manual release of the button 208. Thus, the spring bias force of the piston 224 is slightly greater than a spring bias force of the V shaped spring 234.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A hand held switch assembly comprising:

a rigid manually depressible button;

a movable electromechanical two-stage switch comprising a switch element, the switch element configured to transmit a first type electric signal in response to being moved to a first depth and to transmit a second type electric signal in response to being moved to a second depth greater than the first depth; and a rigid pivoting lever mechanically coupled to both the manually depressible button and to the switch element, the pivoting lever configured to engage and move the switch element in response to a manual depression of the manually depressible button, wherein the pivoting lever is configured to engage and move the switch element to the first depth when the manually depressible button is depressed for a distance greater than a distance of the first depth, and wherein the rigid pivoting lever is configured to move the switch element to the second depth when the manually depressible button is depressed for a distance greater than a distance of the second depth.

2. The switch assembly of claim 1, wherein the pivoting lever is configured to engage and move the switch element to the first depth when the manually depressible button is depressed for a distance about twice the distance of the first depth.

3. The switch assembly of claim 1, further comprising a spring member to bias the pivoting lever against the two-stage switch.

4. The switch assembly of claim 1, wherein the manually depressible button comprises a first end configured to receive a depression force and a second end configured to engage the pivoting lever.

5. The switch assembly of claim 4, wherein the pivoting lever is configured to pivot about a pivot axis, a movement of the switch element to the first depth corresponds to a first amount of angular movement of the pivoting lever, and wherein a movement of the switch element to the second depth corresponds to a second amount of angular movement of the pivoting lever that is greater than the first amount of angular movement.

6. The switch assembly of claim 5, wherein the pivoting lever comprises an opening to receive a pin extending from a portion of a body of the switch assembly, the opening and the pin configured to provide the pivot axis for the pivoting lever.

7. The switch assembly of claim 6, wherein the pivoting lever comprises a first contact area to engage the second end of the manually depressible button, the pivoting lever comprises a second contact area to engage and move the switch element, and wherein a distance from the pivot axis to the first contact area is at least the same as the distance from the pivot axis to the second contact area.

8. The switch assembly of claim 7, wherein the manually depressible button travels along a button line when the manually depressible button is depressed, the switch element travels along a switch line when the switch element is moved, and wherein the pivot axis is offset to one side of both the button line and the switch line.

9. The switch assembly of claim 8, wherein the pivot axis is offset from a line that coincides with the first contact area and the second contact area.

10. The switch assembly of claim 7, wherein the manually depressible button travels along a button line when the manually depressible button is depressed, the switch element travels along a switch line when the switch element is moved, and wherein the button line intersects the switch line at an acute angle of between about 20° and about 50°.

11. The switch assembly of claim 10, wherein the acute angle is selected to be even more preferably between about 25° and 40°.

12. A hand held switch assembly comprising:

a button configured to move to a first button depth and a second button depth;

an electromechanical switch mechanically coupled to the button and configured to transmit a first type electric signal in response to the button being pressed to the first button depth and to transmit a second type electric signal in response to the button being pressed to the second button depth; and a pivoting lever to provide mechanical coupling between the button and the switch, the pivoting lever configured to move a piston in the switch to a first switch depth corresponding to the first button depth and to a second switch depth corresponding to the second button depth and to a second switch depth corresponding the second button depth, wherein a distance of the first button depth and the second button depth are greater than a distance of the first switch depth and the second switch depth, respectively.

13. The switch assembly of claim 12, wherein the button comprises a first end configured to receive a manual depression force and a second end configured to engage the pivoting lever.

14. The switch assembly of claim 12, wherein the pivoting lever is configured to pivot about a pivot axis, a movement of the piston to the first depth corresponds to a first amount of angular movement of the pivoting lever, and wherein a movement of the piston to the second depth corresponds to a second amount of angular movement of the pivoting lever that is greater than the first amount of angular movement.

15. The switch assembly of claim 12, wherein the pivoting lever is configured to pivot about a pivot axis, the pivoting lever comprises an opening to receive a pin extending from a portion of a body of the switch assembly, and wherein the opening and the pin are configured to provide the pivot axis for the pivoting lever.

16. The switch assembly of claim 13, wherein the pivoting lever is configured to pivot about a pivot axis, the pivoting lever comprises a first contact area to engage the second end of the button, the pivoting lever comprises a second contact area to engage and move the piston, and wherein a distance from the pivot axis to the first contact area is greater than the distance from the pivot axis to the second contact area.

17. The switch assembly of claim 16, wherein the button travels along a button line when the button is depressed, the piston travels along a switch line when the piston is moved, the pivot axis is offset to one side of both the button line and the switch line, and wherein the pivot axis is offset to the one side from a line that coincides with the first contact area and the second contact area.

18. The switch assembly of claim 17, wherein the button line intersects the switch line at an acute angle between about 20° and about 50°.

19. The switch assembly of claim 18, wherein the acute angle is selected to be preferably between about 25° and 40°.

20. The switch assembly of claim 12, further comprising a spring member to bias the pivoting lever against the switch.

* * * * *